US006232708B1

(12) United States Patent
Kim et al.

(10) Patent No.: US 6,232,708 B1
(45) Date of Patent: May 15, 2001

(54) CATHODE WITH AN ELECTRON EMITTING LAYER FOR A CATHODE RAY TUBE

(75) Inventors: Suk-ki Kim, Suwon-si; Sang-wook Shin, Kyungki-do; Chul-han Bae, Seoul; Kwong-im Cho, Incheon-si, all of (KR)

(73) Assignee: Samsung Display Devices Co., Ltd., Suwon-si (KR)

( * ) Notice: Subject to any disclaimer, the term of this patent is extended or adjusted under 35 U.S.C. 154(b) by 0 days.

(21) Appl. No.: 09/169,743

(22) Filed: Oct. 8, 1998

(30) Foreign Application Priority Data

Oct. 23, 1997 (KR) ..... 97-54446

(51) Int. Cl.[7] ..... H01J 1/14

(52) U.S. Cl. ..... 313/346 R; 313/346 DC; 313/337

(58) Field of Search ..... 313/346 R, 346 DC, 313/337, 270, 447

(56) References Cited

U.S. PATENT DOCUMENTS 5,808,404 * 9/1998 Koizumi et al. ..... 313/346 R
5,881,355 * 3/1999 Sugimura et al. ..... 419/20

FOREIGN PATENT DOCUMENTS 61-269828 11/1986 (JP) .
2-33822 2/1990 (JP) .

* cited by examiner

*Primary Examiner*—Nimeshkumar D. Patel
*Assistant Examiner*—Karabi Guharay
(74) *Attorney, Agent, or Firm*—Christie, Parker & Hale, LLP

(57) ABSTRACT

A cathode for a cathode ray tube includes a base having a closed top portion and containing nickel as its main component, an electron-emitting material layer coated on the top portion of the base and containing alkali-earth metal oxides as its main component, rare-earth metals or rare-earth metal compounds attached on a surface of the electron-emitting material layer, and a heater placed under the top portion of the base to heat it.

18 Claims, 3 Drawing Sheets

Prior Art

CATHODE WITH AN ELECTRON EMITTING LAYER FOR A CATHODE RAY TUBE

CROSS REFERENCE TO RELATED APPLICATION

This application is based on application No. 97-54446 filed in Korean Industrial Property Office on Oct. 23, 1997, the content of which is incorporated herein by reference.

BACKGROUND OF THE INVENTION (a) Field of the Invention

The present invention relates to a cathode for a cathode ray tube (CRT) and, more particularly, to a cathode which is used in a color CRT to display high-definition color picture images (b) Description of the Related Art Generally, in the CRTs, the cathode is designed to emit electrons for exciting phosphors coated on a faceplate panel. For the electron emission purpose, the cathode is provided with electron-emitting materials and, during operation, the electron-emitting materials are activated to produce the phosphor-exciting electrons.

FIG. 3 is a schematic cross-sectional view showing a conventional CRT cathode. As shown in FIG. 3, the cathode includes a base 31 having a cylindrical shape and an opening portion, and an electron-emitting material layer 32 coated on a closed top portion of the base 31 to emit thermal electrons. The base 31 contains nickel as its main component together with a small amount of reducing elements such as silicon, magnesium, etc. The electron-emitting material layer 32 is formed with alkali-earth metal oxides comprising barium, strontium and calcium.

The cathode further includes a heater 33 placed in the opening portion of the base 31 to heat it up to a predetermined temperature, and a control grid 34 positioned on a front portion of the electron-emitting material layer 32 to focus streams of the electrons emitted therefrom. A tungsten wire coated with alumina is commonly used as the heater 33.

In the meantime, the coating operation of the electron-emitting material layer 32 can be described as shown below.

First, a carbonate suspension containing alkali-earth metals such as barium, strontium, calcium, etc. is applied onto the top portion of the base 31 and heated by the heater 33 in a vacuum state. Then, the alkali-earth metal carbonates are changed into alkali-earth metal oxides. Subsequently, the alkali-earth metal oxides are again heated and aged so that some of the oxides are reduced through reacting with silicon, magnesium, etc. contained in the base 31 to be thereby endowed with a semiconducting property. In this way, the coating of the electron-emitting material layer 32 can be completed.

When the aforementioned electron-emitting material layer 32 is heated up to 800~900° C. in normal conditions, it emits electrons with a current density of 0.5~0.8 A/cm$^2$. However, since high-definition televisions have recently been developed, the need for a fine stream of electrons with a high current density is created and, hence, it is required to heighten the current density of the electrons up to 1~3 A/cm$^2$. But, in case the conventional CRT cathode is employed for that purpose, the electron emission capacity of the cathode abruptly deteriorates so that it would be soon have to be discarded and replaced with a new one.

Therefore, the conventional CRT cathode has been currently improved and adapted to emit electrons with a current density of 1~3 A/cm$^2$.

For example, Japanese Patent Laid-open No. Sho61-269828 discloses a technique of mixing the carbonate suspension of alkali-earth metals such as barium, strontium, calcium, etc. with an oxidizing scandium.

Furthermore, Japanese Patent Laid-open No. Hei2-33822 discloses a technique of attaching rare-earth metals or their compounds on the electron-emitting material layer. In the technique, the attachment is performed through applying the rare-earth metals or their compounds onto a cathode-side surface of the control grid and making the electrons emitted from the cathode to collide against the control grid. In this way, the electrons are scattered toward the electron-emitting material layer and attached thereon.

However, the experimental tests with respect to the CRT cathode manufactured in accordance with the technique disclosed in Japanese Patent Laid-open No. Sho61-269828 exhibited that the electron-emitting material layer 32 was slightly separated from the base 31, creating an unstable electron emission.

Furthermore, the experimental tests with respect to the CRT cathode manufactured in accordance with the technique disclosed in Japanese Patent Laid-open No. Hei2-33822 exhibited that the distance between the electron-emitting material layer 32 and the control grid 34 was extremely short compared to a diameter of the electron guide hole in the control grid 34. As a result, the scattered rare-earth metal oxides were not attached on the center portion of the electron-emitting material layer 32 opposite the electron guide hole. Thus, as a high current density is investigated with the cathode, the electron emission capacity is liable to deteriorate.

SUMMARY OF THE INVENTION

Accordingly, the present invention is directed to a CRT cathode which substantially obviates one or more of the problems due to limitations and disadvantages of the related art.

An object of the present invention is to provide a CRT cathode which is not deteriorated in electron emission capacity even when electrons are emitted therefrom with a current density of 1~3 A/cm$^2$.

Another object of the present invention is to provide a CRT cathode which improves the technique suggested in Japanese Patent Laid-open No. Hei2-33822 such that the rare-earth metals or their compounds can be attached on the center portion of the electron-emitting material layer to thereby heighten the current density of the electrons.

Additional features and advantages of the invention will be set forth in the description which follows, and in part will be apparent from the description, or may be learned by practice of the invention. The objects and other advantages of the invention will be realized and attained by the structure particularly pointed out in the written description and claims hereof as well as the appended drawings.

To accomplish these and other advantages, the CRT cathode includes a base having a closed top portion and containing nickel as its main component, an electron-emitting material layer coated on the top portion of the base and containing alkali-earth metal oxides as its main component, rare-earth metals or their compounds attached on a surface of the electron-emitting material layer, and a heater placed under the top portion of the base to heat it. The CRT cathode further includes a second electron-emitting material layer coated on the rare-earth metals or their compounds and containing alkali-earth metal oxides as its main component.

It is to be understood that both the foregoing general description and the following detailed description are exemplary and explanatory and are intended to provide further explanation of the invention as claimed.

DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention.

Figure 1:
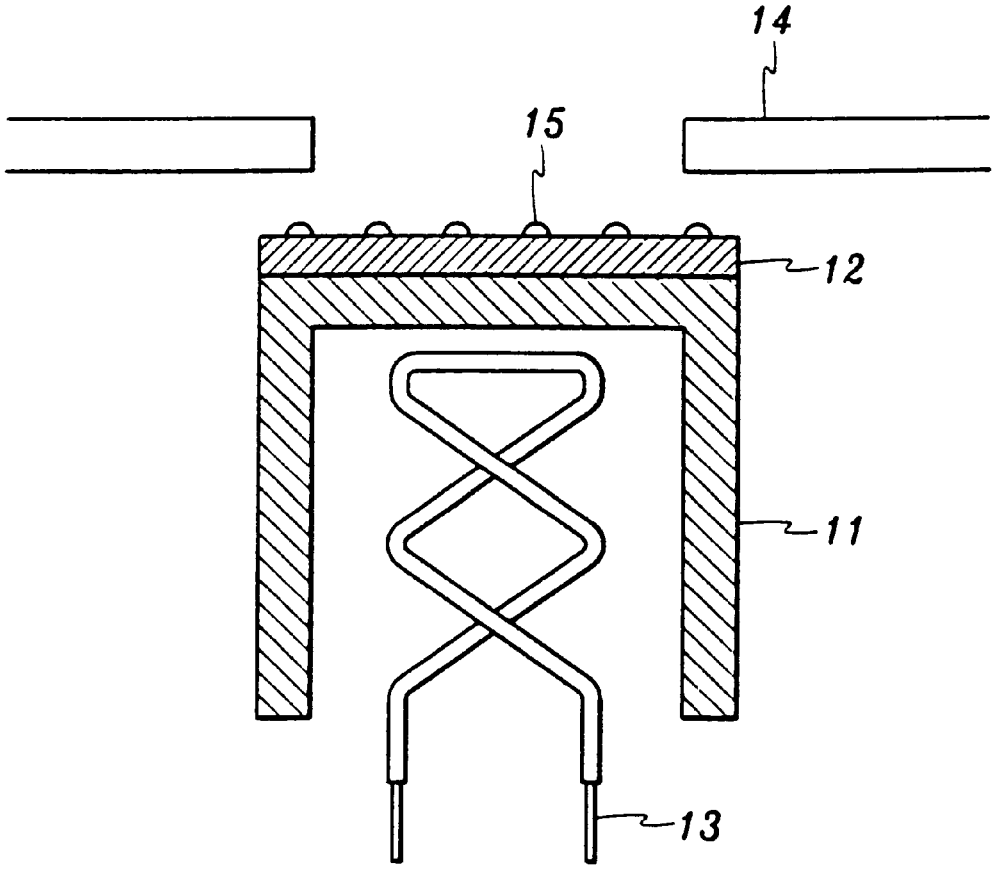
FIG. 1 is a schematic sectional view showing a CRT cathode according to a first preferred embodiment of the present invention.
Figure 2:
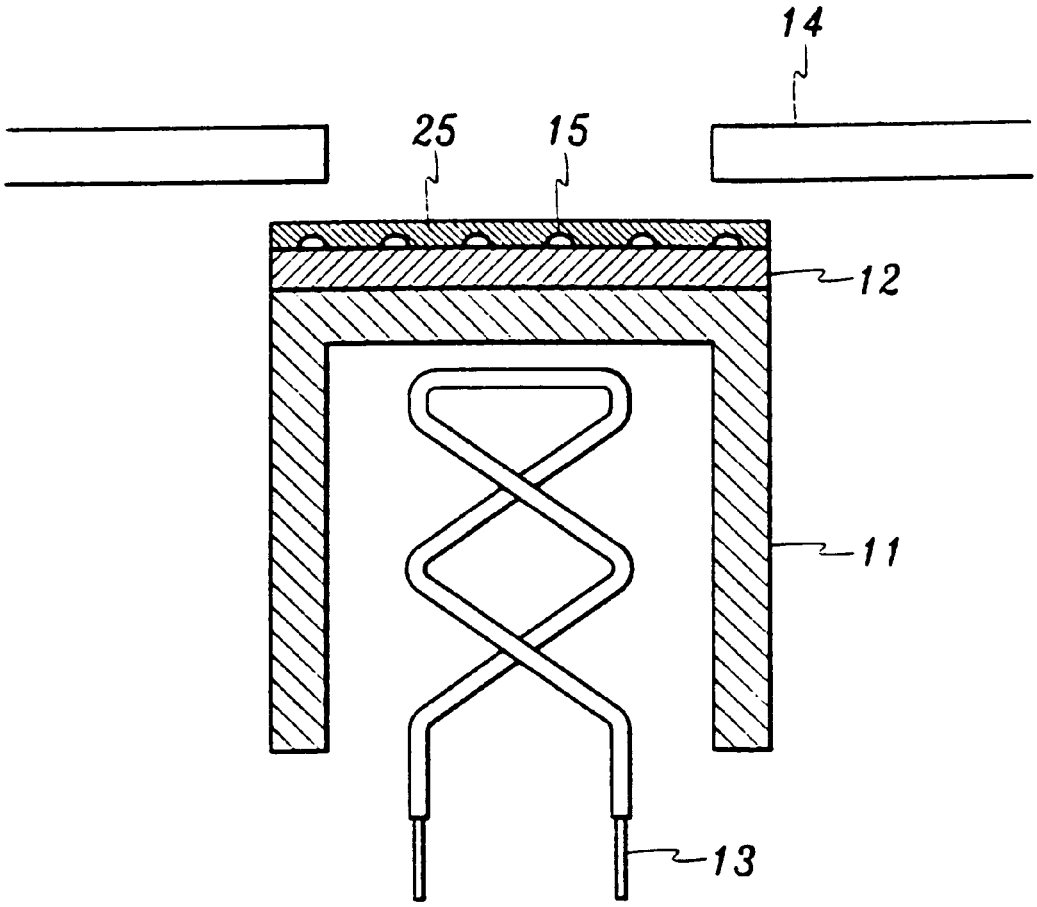
FIG. 2 is a schematic sectional view showing a CRT cathode according to a second preferred embodiment of the present invention.
Figure 3:
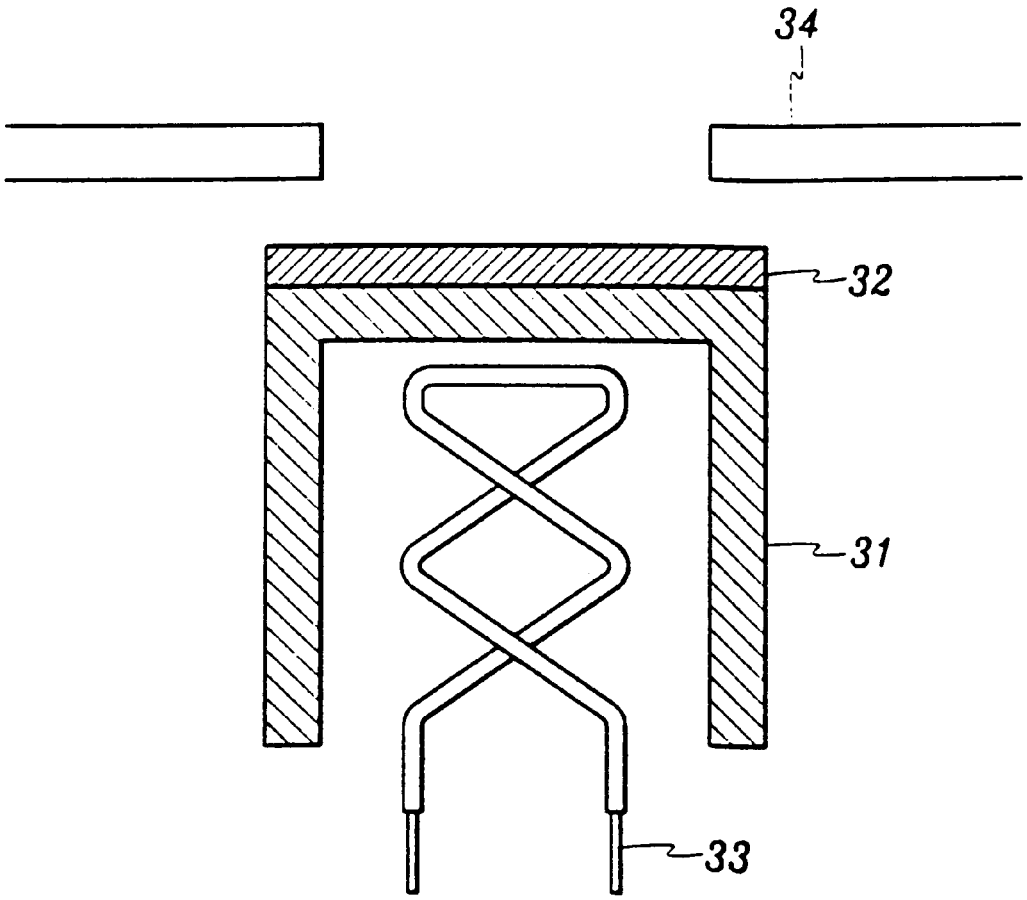
FIG. 3 is a schematic sectional view showing a conventional CRT cathode.

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawing and description are to be regarded as illustrative in nature, and not as restrictive.

DETAILED DESCRIPTION OF THE INVENTION

Reference will now be made in detail to the preferred embodiments of the present invention, examples of which are illustrated in the accompanying drawings.

As shown in FIG. 1, a base 11 has a cylindrical shape and an opening portion. The base 11 is supported by a supporting member (not shown). An electron-emitting material layer 12 is coated on a closed top portion of the base 11. And a control grid 14 is positioned on a front portion of the electron-emitting material layer 12 to focus streams of the electrons emitted therefrom. The control grid 14 is provided with an electron guide hole to guide the streams of the electrons passing therethrough. In addition, a heater 13 is placed in the opening portion of the base 11 to heat it. The base 11 contains nickel as its main component together with a small amount of magnesium and silicon. The electron-emitting material layer 12 is preferably formed with alkali-earth metal oxides comprising barium, strontium, calcium, etc. Rare-earth metals or their compounds 15 are attached on a surface of the electron-emitting material layer 12.

When the rare-earth metals or their compounds are attached on the surface of the electron-emitting material layer 12, it is presumed that the alkali-earth metal oxides of the electron-emitting material layer 12 is partly activated in such a manner as to emit electrons with a high current density. That is, in this state, the alkali-earth metals on the surface of the electron-emitting material layer 12 are endowed with a semiconducting property which serves well to emit the electrons.

Meanwhile, it is necessary that the rare-earth metals or their compounds 15 should be attached on the center portion of the electron-emitting material layer 12 because the electrons are much emitted in the vicinity of that portion opposite to the electron guide hole in the control grid 14.

The rare-earth metal compounds 15 preferably include $Ba_2Sc_2O_5$ and/or $Ba_3Sc_4O_9$. The conventional dropping, spraying or depositing method can be used in coating the rare-earth metals or their compounds 15 on the electron-emitting material layer 12.

In the meantime, the rare-earth metals or their compounds 15 cannot emit electrons for themselves. Therefore, it should be noted that when the rare-earth metal suspension is plentifully attached on the surface of the electron-emitting material layer 12, the exposed area of the electron-emitting material layer 12 may become extremely narrow, thereby detenorating the electron emission capacity. Thus, in order to prevent deterioration in the electron emission capacity, a second electron-emitting material layer 25 may be again coated on the rare-earth metals or their compounds 15.

In this preferred embodiment, the rare-earth metal suspension is in the range of 0.5~5 weight percent of the alkali-earth metal suspension for the electron-emitting material layer.

The CRT cathode manufacturing process will be now described in detail.

First, an alkali-earth metal suspension is prepared by adding butylacetate and 1000 cc of nitrocellulose lacquer to 2090 g of alkali-earth metal carbonates containing barium, strontium and calcium. The nitrocellulose lacquer is prepared from a mixture of 2750 cc of isoamylacetate, 280 cc of diethyloxalate and 18.7 g of nitrocellulose.

Then, this alkali-earth metal suspension is coated on the closed top portion of the base 11 with a thickness of 70 $\mu$m by using a spray method to form an electron-emitting material layer.

Thereafter, a rare-earth metal suspension is prepared by adding butylacetate and 100 cc of nitrocellulose lacquer to 10 g of $Ba_2Sc_2O_5$. The suspension is then attached on the surface of the electron-emitting material layer by using a spray method.

The resulting CRT cathode exhibits a good electron emission characteristic. That is, deterioration in electron emission capacity is not generated even when electrons are emitted from the cathode with a current density of 1~3 $A/cm^2$.

It will be apparent to those skilled in the art that various modifications and variations can be made in the CRT cathode of the present invention without departing from the spirit or scope of the invention. Thus, it is intended that the present invention cover modifications and variations of this invention provided they come within the scope of the appended claims and their equivalents.

What is claimed is:

1. A cathode for a cathode ray tube, the cathode comprising:

a base having a closed top portion and containing nickel as a main component thereof;

an electron-emitting material layer coated on the top portion of the base and containing alkali-earth metal oxides as a main component thereof;

a material consisting essentially of rare-earth metals or rare-earth metal compounds attached on a surface of the electron-emitting material layer; and a heater placed under the top portion of the base to heat the base.

2. The cathode of claim 1, further comprising a second electron-emitting material layer coated on the rare-earth metals or the rare-earth metal compounds.

3. The cathode of claim 2, wherein the rare-earth metal compounds comprise $Ba_2Sc_2O_5$ and $Ba_3Sc_4O_9$.

4. The cathode of claim 2, wherein the rare-earth metals or the rare-earth metal compounds are attached on the surface of the electron-emitting material layer by spraying a suspension of rare-earth metals or rare-earth metal compounds thereon.

5. The cathode of claim 2, wherein the rare-earth metals or the rare-earth metal compounds are attached on the surface of the electron-emitting material layer by dropping a suspension of rare-earth metals or rare-earth metal compounds thereon.

6. The cathode of claim 1, wherein the rare-earth metal compounds comprise $Ba_2Sc_2O_5$ and $Ba_3Sc_4O_9$.

7. The cathode of claim 1, wherein the rare-earth metals or the rare-earth metal compounds are attached on the surface of the electron-emitting material layer by spraying a suspension of rare-earth metals or rare-earth metal compounds thereon.

8. The cathode of claim 1, wherein the rare-earth metals or the rare-earth metal compounds are attached on the surface of the electron-emitting material layer by dropping a suspension of rare-earth metals or rare-earth metal compounds thereon.

9. A cathode for a cathode ray tube, the cathode comprising:

a base having a closed top portion;

an electron-emitting material layer on the top portion of the base and comprising alkali-earth metal oxides; and a material consisting essentially of rare-earth metals or rare-earth metal compounds disposed on a surface of the electron-emitting material layer.

10. The cathode of claim 9, further comprising a second electron-emitting material layer on the rare-earth metals or the rare-earth metal compounds.

11. The cathode of claim 10, wherein the rare-earth metal compounds comprise $Ba_2Sc_2O_5$ and $Ba_3Sc_4O_9$.

12. The cathode of claim 10, wherein the rare-earth metals or the rare-earth metal compounds are disposed on the surface of the electron-emitting material layer by spraying a suspension of rare-earth metals or rare-earth metal compounds thereon.

13. The cathode of claim 10, wherein the rare-earth metals or the rare-earth metal compounds are disposed on the surface of the electron-emitting material layer by dropping a suspension of rare-earth metals or rare-earth metal compounds thereon.

14. The cathode of claim 10, wherein the second electron-emitting material layer consists essentially of alkali-earth metal oxides.

15. The cathode of claim 9, wherein the rare-earth metal compounds comprise $Ba_2Sc_2O_5$ and $Ba_3Sc_4O_9$.

16. The cathode of claim 9, wherein the rare-earth metals or the rare-earth metal compounds are disposed on the surface of the electron-emitting material layer by spraying a suspension of rare-earth metals or rare-earth metal compounds thereon.

17. The cathode of claim 9, wherein the rare-earth metals or the rare-earth metal compounds are disposed on the surface of the electron-emitting material layer by dropping a suspension of rare-earth metals or rare-earth metal compounds thereon.

18. The cathode of claim 9, further comprising a heater positioned under the top portion of the base.

* * * * *